US011565858B1

(12) United States Patent
Wu

(10) Patent No.: US 11,565,858 B1
(45) Date of Patent: Jan. 31, 2023

(54) CONTAINER LID ASSEMBLY

(71) Applicant: Hung Kuan Wu, Taipei (TW)

(72) Inventor: Hung Kuan Wu, Taipei (TW)

( * ) Notice: Subject to any disclaimer, the term of this patent is extended or adjusted under 35 U.S.C. 154(b) by 0 days.

(21) Appl. No.: 17/395,833

(22) Filed: Aug. 6, 2021

(51) Int. Cl.
*B65D 50/06* (2006.01)
*A61J 1/03* (2006.01)
*B65D 51/24* (2006.01)

(52) U.S. Cl.
CPC ..... *B65D 50/061* (2013.01); *A61J 1/03* (2013.01); *B65D 51/245* (2013.01)

(58) Field of Classification Search
CPC ..... B65D 50/061; B65D 51/2451; B65D 51/245; A61J 1/03; A61J 7/04
See application file for complete search history.

(56) References Cited

U.S. PATENT DOCUMENTS

2010/0122966 A1* 5/2010 Wu ..... B65D 47/283 215/354
2011/0099082 A1* 4/2011 Walker ..... G06Q 20/28 705/26.8
2017/0202748 A1* 7/2017 Gosselin ..... B65D 41/0478
2018/0250196 A1* 9/2018 Warden ..... B65D 41/04
2018/0318174 A1* 11/2018 Gosselin ..... A61J 7/04
2019/0343728 A1* 11/2019 Nazginov ..... A61J 1/1418
2020/0399034 A1* 12/2020 Wu ..... B65D 51/18
2022/0258930 A1* 8/2022 Park ..... B65D 51/24

* cited by examiner

*Primary Examiner* — Shawn M Braden
(74) *Attorney, Agent, or Firm* — Rosenberg. Klein & Lee

(57) ABSTRACT

A container lid assembly includes a movable lid unit, a cylindrical locking device, an arcuate plate, an annular cover, and a container. A rotation of the movable lid unit and subsequent operations show change of symbol of a symbol ring and capsules in the container can be taken out of the tubular insertion member. It can correctly record the number of times of the container being opened. The container lid assembly further provides a space for storing another kind of medicine in the lid.

1 Claim, 8 Drawing Sheets

CONTAINER LID ASSEMBLY

BACKGROUND OF THE INVENTION

1. Field of the Invention

The invention relates to container lids and more particularly to a lid assembly for a container containing capsules or other granular objects, the lid assembly being capable of correctly recording the number of times of the container being opened for taking out capsules.

2. Description of Related Art

A medicine container, such as a capsule container, generally has a larger opening and it is difficult of taking out the desired number of capsules in one time. It is often that many capsules are taken out. It is further often that a lot of capsules are dropped on the ground due to insufficient care. This can be a serious issue to patients who tend to forget whether they have taken their medicine. And in turn, the patient may take medicine repeatedly or does not take any medicine.

In view of the above, the present inventor invented two container lids capable of overcoming the aforesaid drawbacks. One invention was granted Taiwan Utility Model No. M359519, entitled "Structural improvement of container lid" and the other invention was granted Taiwan Utility Model No. M377396, entitled "Further improvement of container lid". Patent applications for the same utility models were also filed in the US and were allowed as U.S. Pat. No. 8,091,719, entitled "Container cap" and U.S. Pat. No. 8,136,687, entitled "Cover of container" respectively. The present inventor further devised a container lid assembly which is published as US Publication No. 2020/0399034 A1.

During the actual manufacturing processes, however, the present inventor found that there is a common problem among the patents and publication as detailed below.

Referring to FIG. 1, it is a view of US Publication No. 2020/0399034 A1. As shown, the vertically movable member 400 of the movable lid unit 10000 is hollow cylindrical and includes threads on an inner surface and an annular bottom 400*a*.

Referring to FIG. 2, it is another view of US Publication No. 2020/0399034 A1. As shown, the container 600 includes an externally threaded neck 600*a* adapted to threadedly secure to the vertically movable member 400.

However, capsules may be clogged at the neck 600*a* if the capsules are relatively large in a process of filling the container 600 with capsules. This can stop the process and lower efficiency.

The present inventor realized the problem and devises a container lid assembly of the present invention which is capable of preventing capsules from being accidentally taken out of a container, correctly recording the number of times of the container being opened, and releasably securing to the container having a large opening so as to facilitate the process of filling large or small capsules in the container.

The container lid assembly of the present invention further provides a space for storing another kind of medicine (e.g., one for first-aid).

SUMMARY OF THE INVENTION

It is therefore one object of the invention to provide a container lid assembly capable of correctly recording the number of times of the container being opened for taking out capsules, having a space in the lid for storing another kind of medicine (e.g., one for first-aid), and the container lid assembly being releasably secured to the container to facilitate capsule management and carrying.

For achieving above and other objects, the invention provides a container lid assembly which can be opened for taking out capsules by performing a series of steps with the number of times of the container being opened recorded and shown so that a patient is fully aware of the number of capsules being taken to prevent a repeat medicine taking from occurring. Further, the container lid assembly is provided with a space in the lid for storing another kind of medicine (e.g., one for first-aid), and the container lid assembly is releasably secured to the container to facilitate capsule management and effect mass production and cost reduction.

The above and other objects, features and advantages of the invention will become apparent from the following detailed description taken with the accompanying drawings.

DETAILED DESCRIPTION OF THE INVENTION

Figure 1:
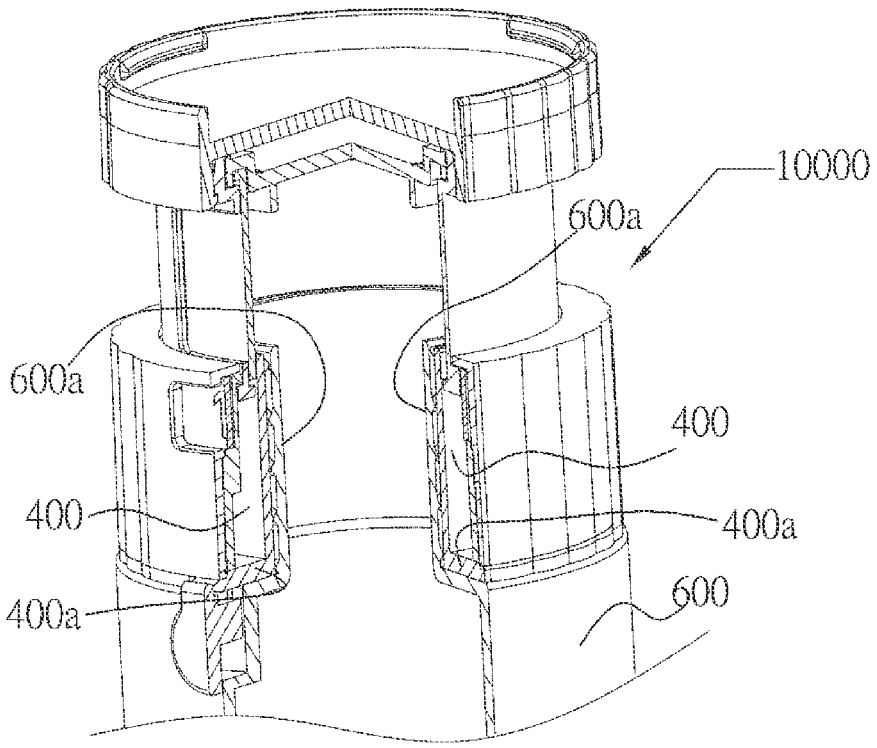
Prior Art FIG.1
FIG. 1 is a perspective, in part section of a container lid assembly of US Publication No. 2020/0399034 A1.
Figure 2:
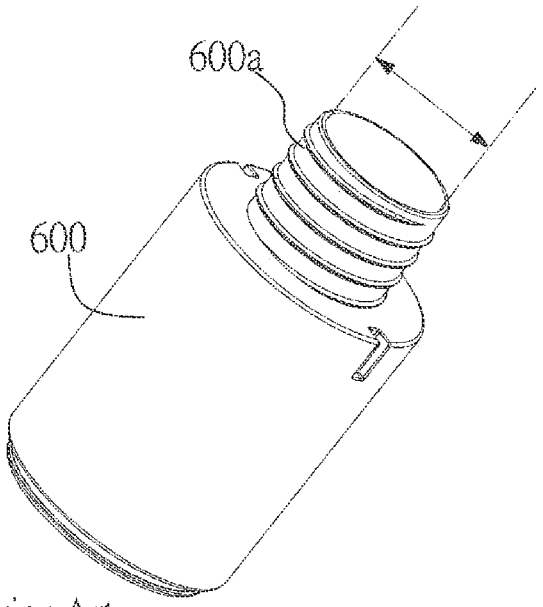
Prior Art FIG.2
FIG. 2 is a perspective view of a container for use with the container lid assembly of FIG. 1.
Figure 3:
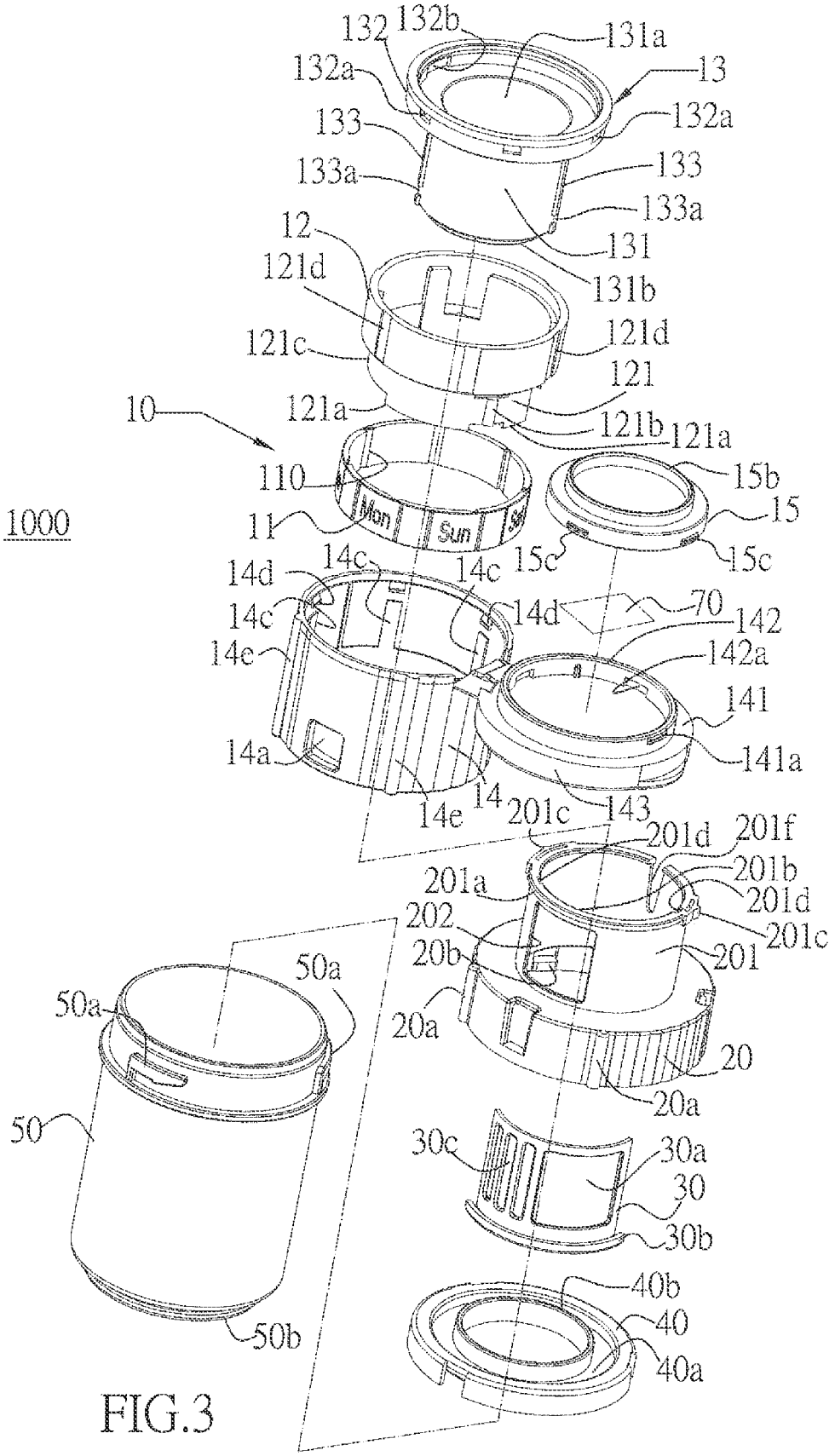
FIG. 3 is an exploded view of a container lid assembly according to the invention and a container for use with it.
Figure 4:
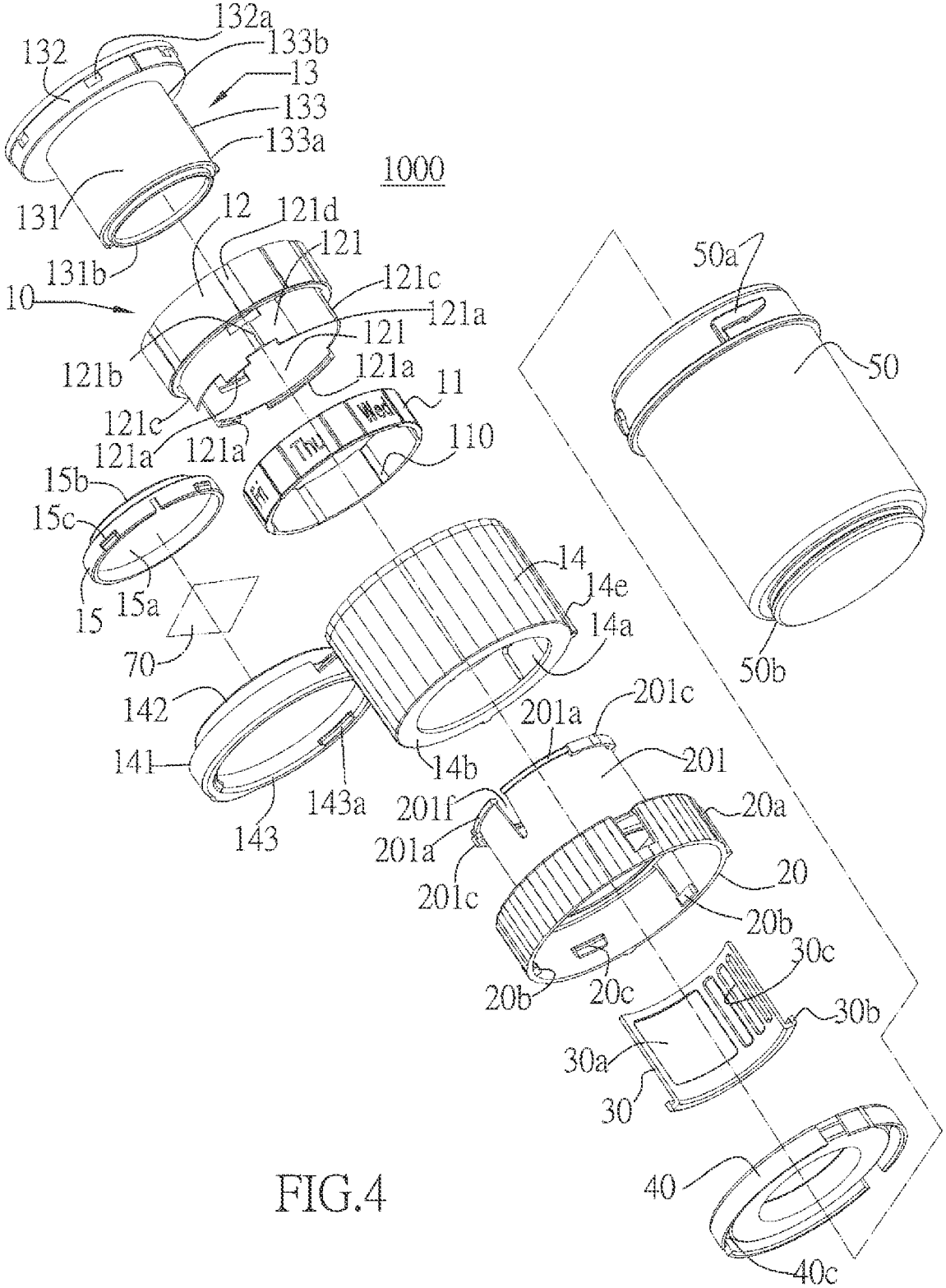
FIG. 4 is another view of FIG. 3.
Figure 6:
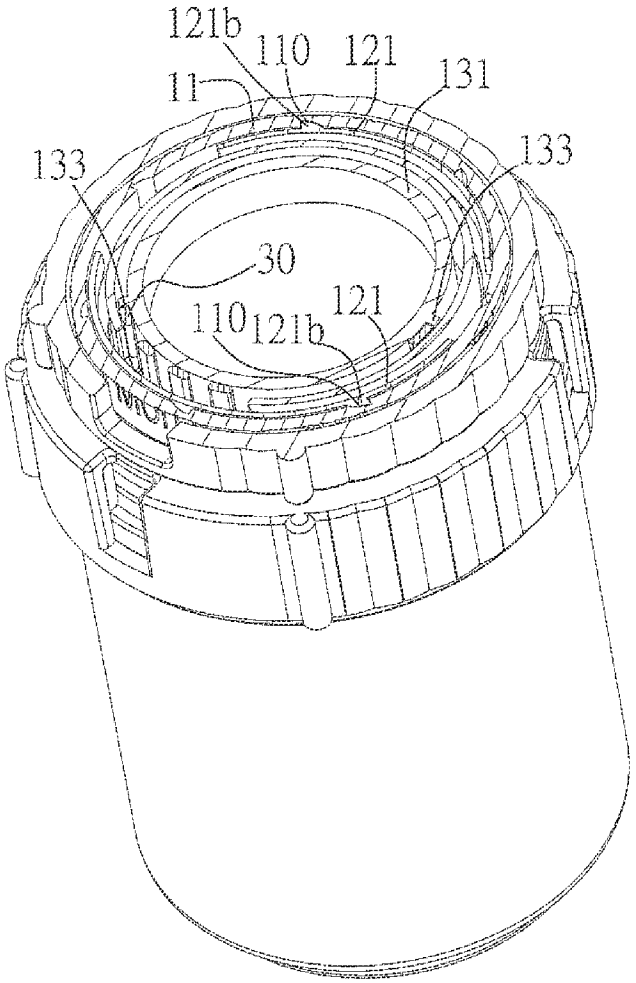
FIG. 6 is a perspective view of the assembled container lid assembly and the container.

Referring to FIGS. 3 to 10, a container lid assembly 1000 in accordance with the invention comprises the following components as discussed in detail below.

A movable lid unit 10 includes a rotatable symbol ring 11 having a plurality of spaced symbols on an outer surface and a plurality of spaced recesses 110 on an inner surface; and an annular ratchet seat 12 includes a plurality of spaced cavities 121*d* on an outer surface, and two downwardly extending, opposite teeth 121 each having a downward extending peg 121*a*, a protrusion 121*b*, and a projection 121*c* extending laterally from the downward extending peg 121*a*. The protrusions 121*b* are complimentarily received in the spaced recesses 110 when the opposite teeth 121 of the ratchet seat 12 and the rotatable symbol ring 11 are assembled. Thus, the rotatable symbol ring 11 is allowed to rotate in only one direction.

The movable lid unit 10 further comprises a storing member 13 including a hollow cylinder 131 having a closed bottom, an internal space 131*a*, and a rim 131*b* on an underside; an annular flange 132 on a top, the annular flange 132 having a plurality of spaced holes 132*a* on an outer surface, and a snapping hole 132*b* on an inner surface; and two opposite ridges 133 on an outer surface of the hollow cylinder 131, each opposite ridge 133 having an opening 133*a* on a bottom, and a recessed portion 133*b* between a bottom of the annular flange 132 and a top of the opposite ridge 133. The hollow cylinder 131 is disposed in the ratchet seat 12.

The movable lid unit 10 further comprises a cylindrical, moveable housing 14 including two spaced ribs 14*e* on an outer surface, an opening 14*a*, a bottom 14*b*, a plurality of spaced protuberances 14*c* on an inner surface, the protuberances 14*c* configured to complementarily dispose in the spaced cavities 121*d*, and a plurality of spaced projecting members 14*d* on the inner surface, the spaced projecting members 14*d* configured to complementarily dispose in the spaced holes 132*a*. The ratchet seat 12 is inserted into the moveable housing 14 with the protuberances 14*c* disposed in the cavities 121*d* respectively. The bottom 14*b* of the moveable housing 14 prevents the ratchet seat 12 from being disengaged from the rotatable symbol ring 11. The opening 14*a* of the moveable housing 14 corresponds to one of the symbols of the rotatable symbol ring 11 so that any symbol aligned with the opening 14*a* is visible through the opening 14*a*.

The moveable housing 14 further comprises a hinged lid 141 including an annular groove 142 on a bottom, a plurality of snapping holes 142*a* on an inner surface, an annular flange 143 on a top, a plurality of projecting members 143*a* on an inner surface of the annular flange 143, and a projecting element 141*a* on an outer surface of the annular groove 142. A chip 70 is disposed on a central portion of the bottom of the hinged lid 141.

A circular member 15 includes a plurality of projecting members 15*c* configured to complementarily dispose in the snapping holes 142*a* respectively, a recessed top 15*a* for covering the chip 70, and an annular flange 15*b* on a bottom. The circular member 15 is disposed in the bottom of the hinged lid 141.

A locking device 20 is a cylindrical body and includes two spaced ribs 20*a* on a surface and an upwardly projecting tubular insertion member 201. A locking device 20 includes a plurality of projecting members 20*b* on an inner surface, a plurality of projecting elements 20*c* on the inner surface, an opening 202 through a surface of the tubular insertion member 201, an outward extending rim 201*a* on a top, an inward extending rim 201*b* on the top, two opposite tabs 201*c* on the outward extending rim 201*a*, and two spaced recesses 201*d* on the inward extending rim 201*b* with the opposite ridges 133 moveably disposed therein. The inward extending rim 201*b* is configured to rotate on the recessed portion 133*b*. The tubular insertion member 201 further comprises a gap 201*f* through the outward extending rim 201*a*, the inward extending rim 201*b*, and the surface. The size of the gap 201*f* is flexibly decreased when the tubular insertion member 201 is in the assembled state. The ratchet seat 12 is in the moveable housing 14 and the ratchet seat 12 and the tubular insertion member 201 are assembled. The tubular insertion member 201 may move upward or downward in the ratchet seat 12. The downward extending peg 121*a* catches the outward extending rim 201*a* so that the ratchet seat 12 is prevented from being disengaged from the tubular insertion member 201.

An arcuate plate 30 includes an opening 30*a* through a surface, a plurality of holes 30*c* through the surface, and a flange 30*b* on a bottom. The arcuate plate 30 is inserted through the bottom of the locking device 20 into the tubular insertion member 201 to dispose between the two opposite ridges 133. The holes 30*c* are blocked by the tubular insertion member 201 and the flange 30*b* urges against the bottom of the locking device 20.

An annular cover 40 includes an annular trough 40*a* on a top with the flange 30*b* received therein, an annular flange 40*b* in a central portion of the annular trough 40*a*, and an annular groove 40*c* on a bottom. The annular cover 40 is provided at the bottom of the locking device 20. The projecting elements 20*c* urge against an outer surface of the annular cover 40. As a result, the container lid assembly 1000 is assembled.

A container 50 includes a plurality of protuberances 50*a* on an outer surface of a narrow upper portion, and an annular protrusion 50*b* on an outer surface of a narrow lower portion. The projecting members 143*a* is on an inner surface of the annular flange 143, and the annular flange 143 on the top of the hinged lid 141 of the movable lid unit 10. The projecting members 143*a* clamp the protrusion 50*b* in a fastened state.

The projecting members 20*b* are fastened by the protuberances 50*a* when the bottom of the locking device 20 and the container 50 are assembled. A top of the container 50 is rotatably disposed in the annular groove 40*c*.

Figure 8:
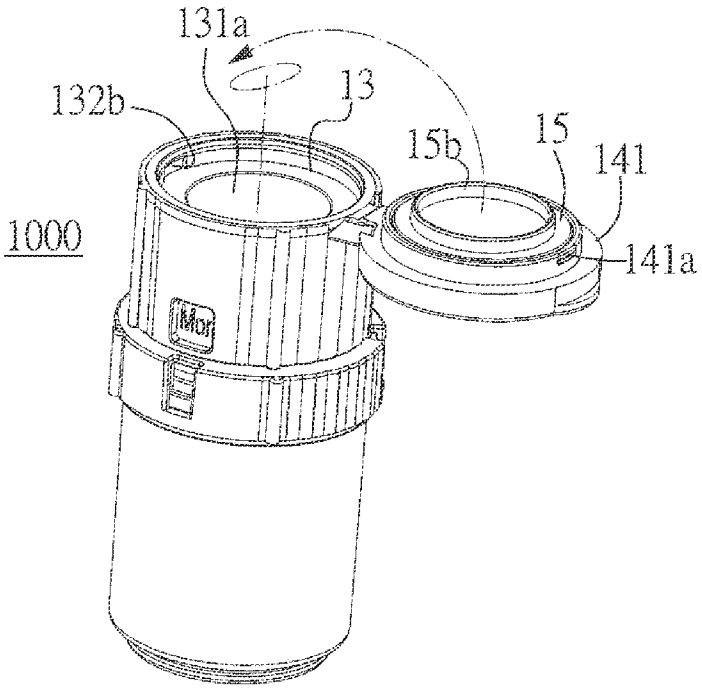
FIG. 8 is a perspective view of the container lid assembly and the container, with the lid opened.

As shown in FIG. 8 specifically, it is a perspective view of the assembled container lid assembly 1000 and the container 50 with the hinged lid 141 open. The internal space 131*a* can store another kind of medicine (e.g., one for first-aid). The hinged lid 141 may be pivoted to close the internal space 131*a* by inserting the projecting element 141*a* into the snapping hole 132*b*. Also, the annular flange 15*b* urges against the storing member 13 in an airtight manner.

Figure 5:
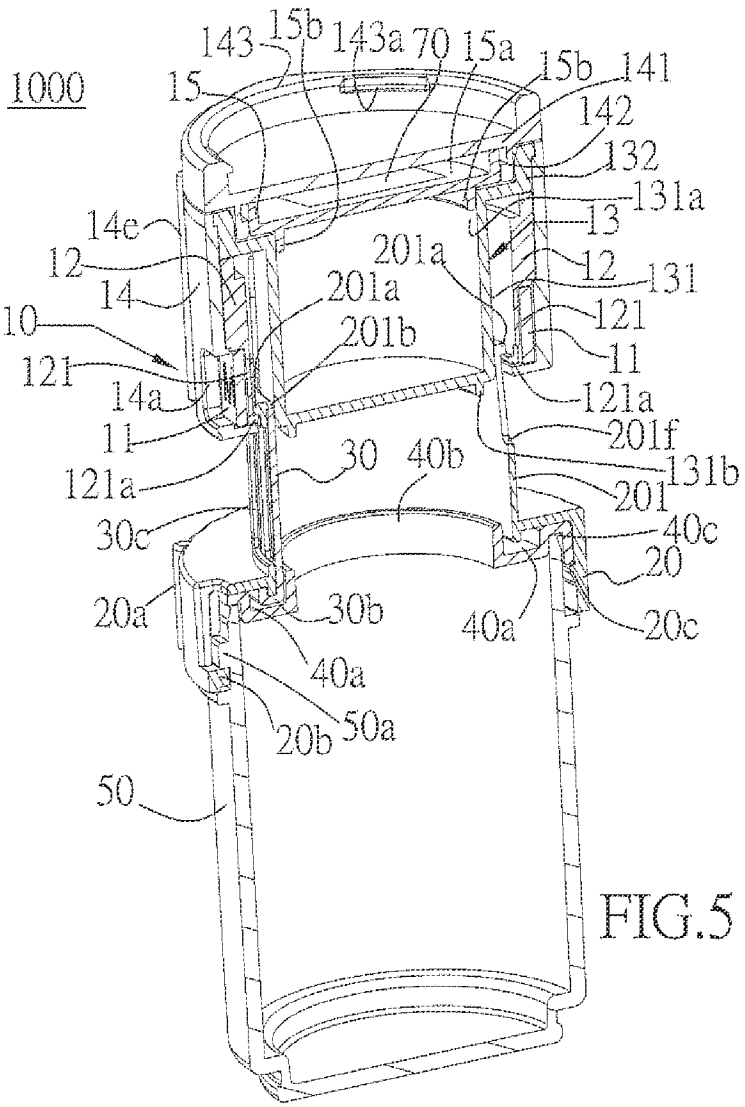
FIG. 5 is a longitudinal sectional view of the assembled container lid assembly and the container.
Figure 6A:
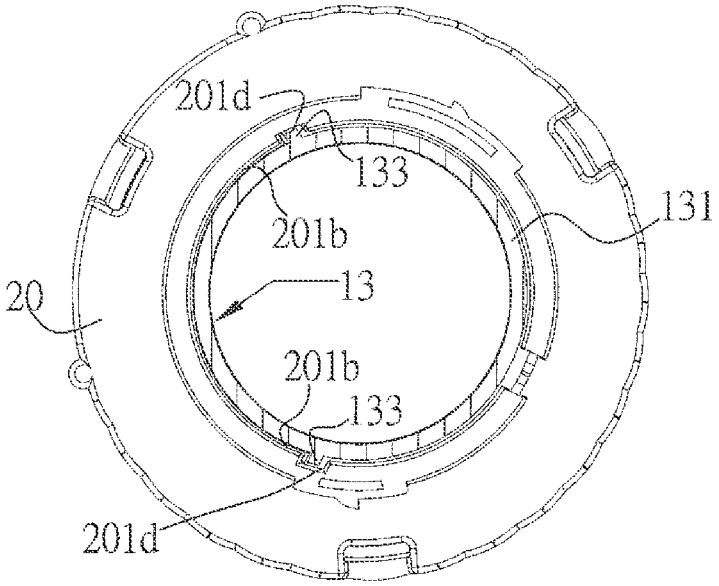
FIG. 6A is a top view of FIG. 6 showing the ridges of the cylindrical member inserted into the recesses of the tubular insertion member respectively.
Figure 6B:
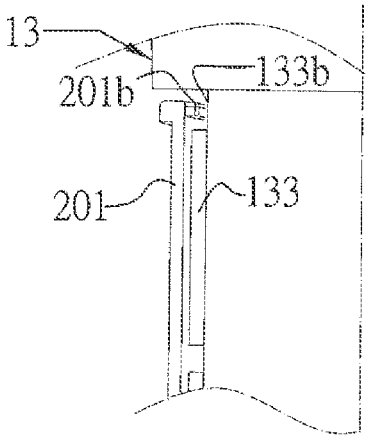
FIG. 6B schematically depicts the ridge of the cylindrical member in the recess of the tubular insertion member.
Figure 6C:
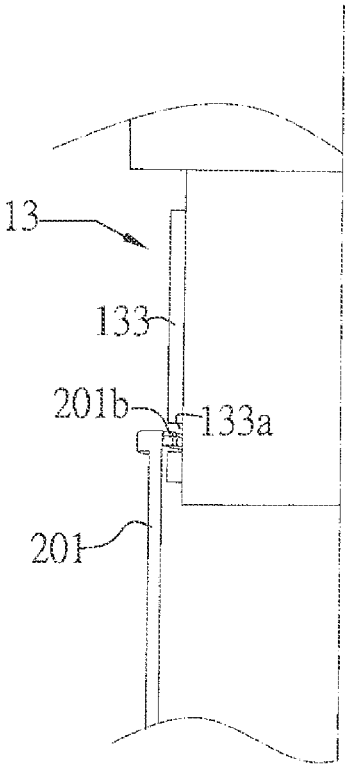
FIG. 6C schematically depicts a pulling of the storing member to move the ridge of the cylindrical member relative to the recess of the tubular insertion member.
Figure 7:
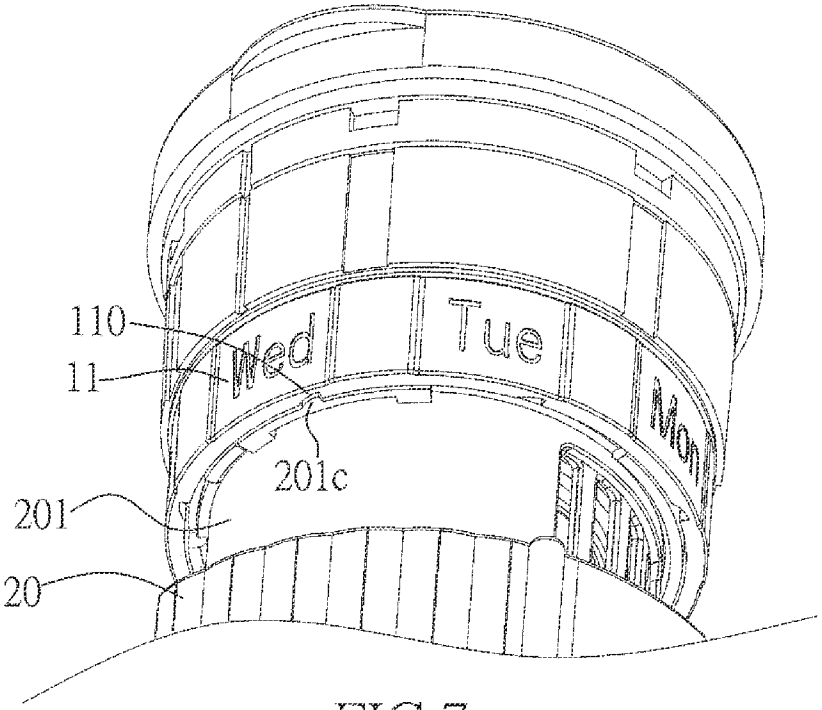
FIG. 7 is a perspective view showing the tab of the tubular insertion member locked in the recess of the rotatable symbol ring.
Figure 9:
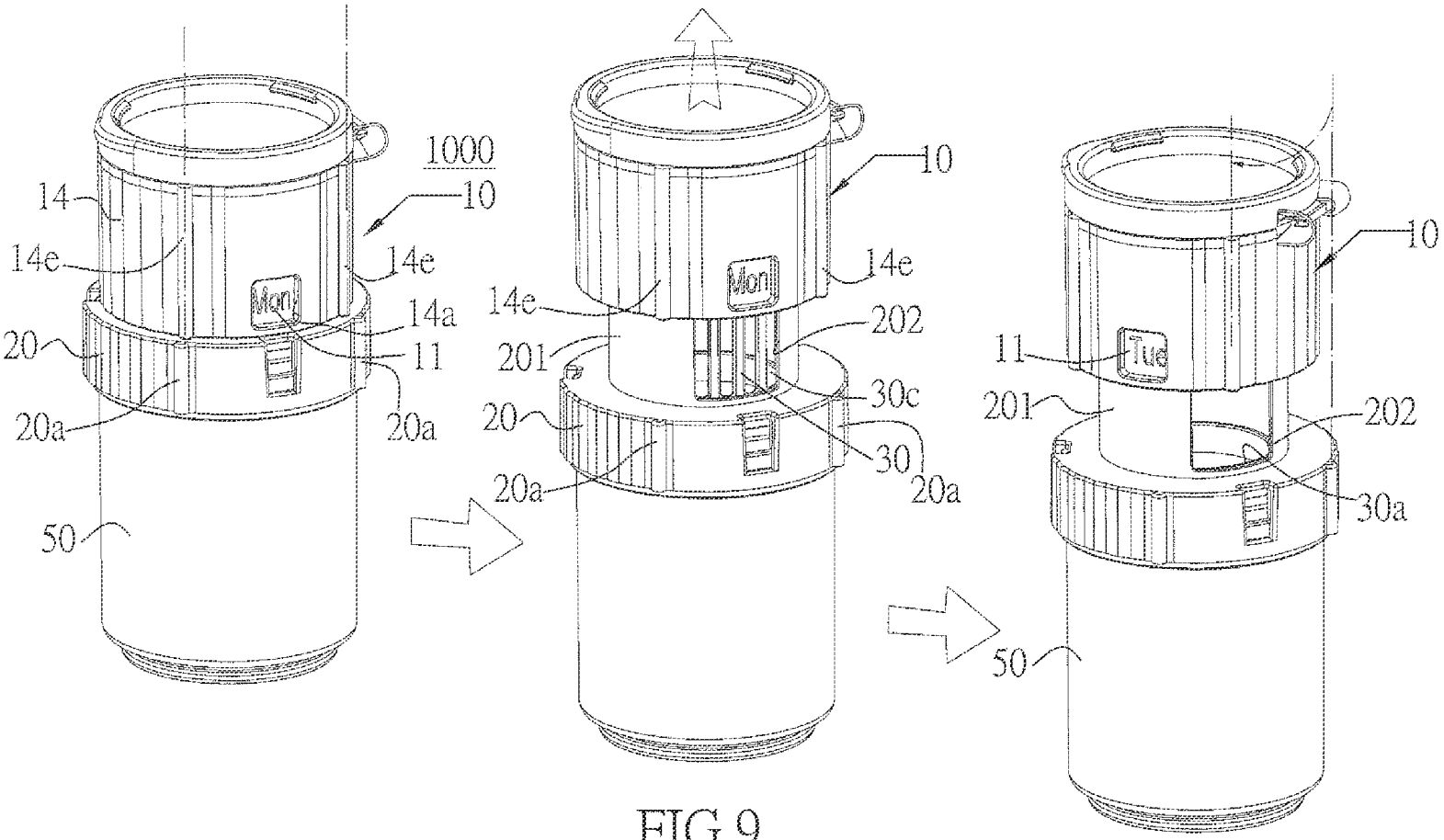
FIG. 9 schematically depicts three states of use of the container lid assembly of the invention.

As shown in FIG. 9 specifically, it schematically depicts three states of use of the container lid assembly 1000. The container lid assembly 1000 is releasably secured to the container 50. In the left side of FIG. 9, the movable lid unit 10 is locked by the locking device 20. The movable lid unit 10 can rotate only but cannot be opened. Thus, it is impossible of taking capsules out of the container 50. For taking out the capsules, a person may rotate the movable lid unit 10 to align the ribs 14*e* with the ribs 20*a* respectively (see the intermediate portion of FIG. 9). Also, the opposite ridges 133 are inserted into the recesses 201*d* respectively (see FIGS. 6A and 6B). Further, the person may pull the movable lid unit 10 until being stopped (see FIG. 6C). At this position, the opening 133*a* is aligned with the inward extending rim 201*b*. As shown in FIG. 5, the downward extending peg 121*a* catches the outward extending rim 201*a* so that the ratchet seat 12 is prevented from being disengaged from the tubular insertion member 201. Also, the holes 30*c* are blocked by the tubular insertion member 201, i.e., being closed. As shown in FIG. 7, the two opposite tabs 201*c* of the tubular insertion member 201 is locked in the spaced recess 110 of the rotatable symbol ring 11, i.e., the movable lid unit 10 positioned.

Figure 10:
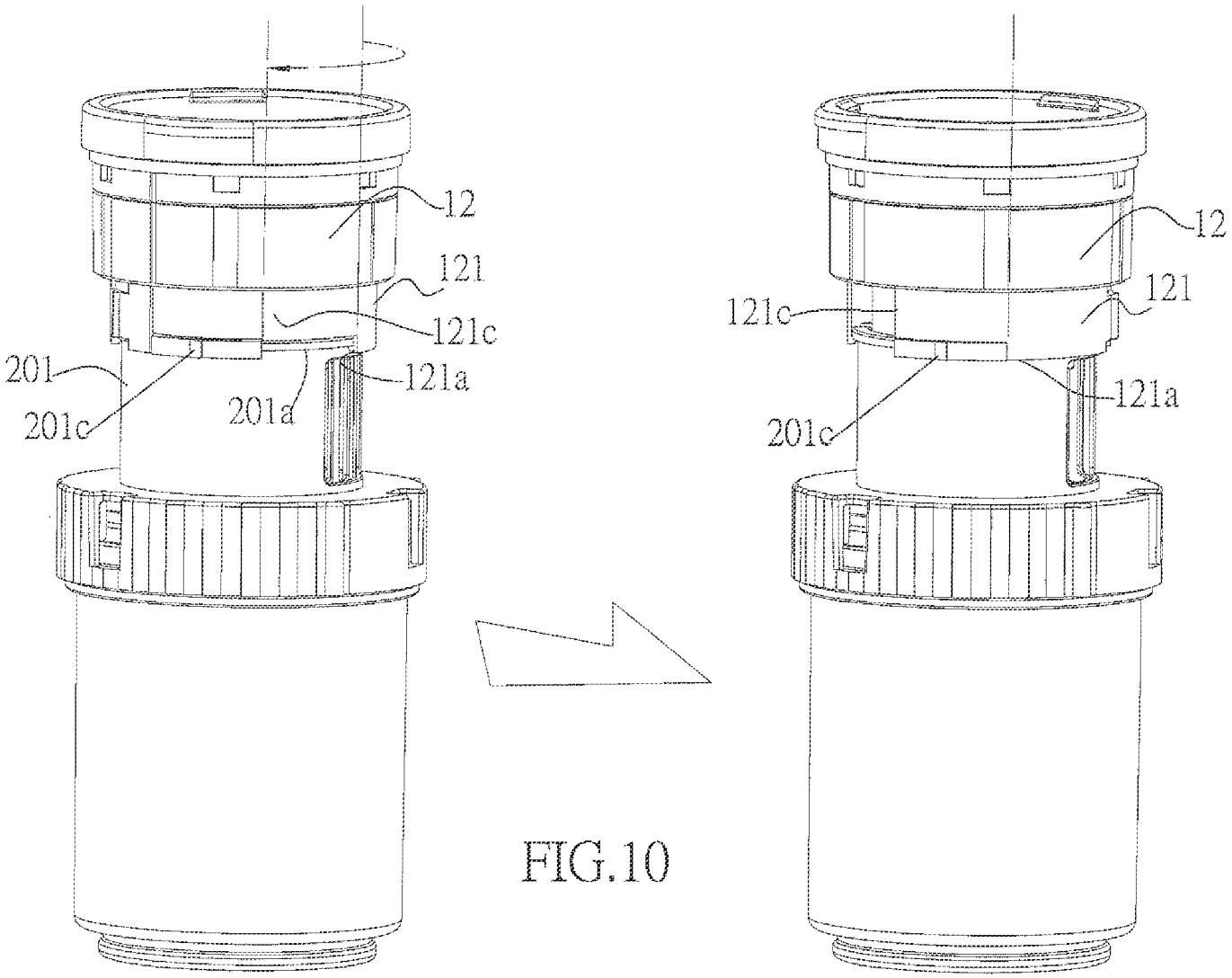
FIG. 10 schematically depicts a rotating operation of the ratchet seat until being stopped at a desired position.

As shown in FIG. 10 specifically, it schematically depicts a rotating operation of the ratchet seat 12 until being stopped at a desired position. In detail, the downward extending peg 121*a* urges against the opposite tabs 201*c*. The projection 121*c* is on a top of the opposite tabs 201*c* to prevent the movable lid unit 10 from moving downward. The opening 202 of the tubular insertion member 201 is aligned with the opening 30*a* of the arcuate plate 30, i.e., being open and the rotatable symbol ring 11 rotates to show change of symbol, i.e., for example from "Mon" to "Tue". Thus, the capsules can be taken out of the opening 202 of the tubular insertion member 201.

After the capsules have been taken out, a reverse operation of the steps described in the above paragraph closes the opening 202. In detail, the rotatable symbol ring 11 is prohibited from rotating in an opposite direction when the protrusions 121*b* are complimentarily received in the spaced recesses 110 (see FIG. 6). The person may see the symbol of the rotatable symbol ring 11 through the opening 14*a* to be aware of the times of the capsules having been taken out.

While the invention has been described in terms of preferred embodiments, those skilled in the art will recognize that the invention can be practiced with modifications within the spirit and scope of the appended claims.

What is claimed is:

1. A container lid assembly, comprising:

a movable lid unit including a rotatable symbol ring having a plurality of spaced symbols on an outer surface and a plurality of spaced recesses on an inner surface; an annular ratchet seat including a plurality of spaced cavities on an outer surface, and two downwardly extending, opposite teeth each having a downward extending peg, a protrusion, and a projection extending laterally from the downward extending peg wherein the protrusions are complimentarily received in the recesses of the symbol ring when the opposite teeth of the ratchet seat and the rotatable symbol ring are assembled so that the rotatable symbol ring is allowed to rotate in only one direction; a storing member including a hollow cylinder having a closed bottom, an internal space, and a rim on an underside, an annular flange on a top, the annular flange having a plurality of spaced holes on an outer surface, and a snapping hole on an inner surface, two opposite ridges on an outer surface of the hollow cylinder, each ridge having an opening on a bottom, and a recessed portion between a bottom of the annular flange and a top of the ridge wherein the hollow cylinder is disposed in the ratchet seat; a cylindrical, moveable housing including two spaced ribs on an outer surface, a top opening, a bottom, a plurality of spaced protuberances on an inner surface, the protuberances configured to complementarily dispose in the cavities of the ratchet seat, and a plurality of spaced projecting members on the inner surface, the projecting members configured to complementarily dispose in the holes of the storing member wherein the ratchet seat is inserted into the housing with the protuberances of the housing disposed in the cavities of the ratchet seat respectively so that the bottom of the housing is configured to prevent the ratchet seat from being disengaged from the symbol ring and the opening of the housing is configured to align with and show one of the symbols of the symbol ring; a hinged lid including an annular groove on a bottom, a plurality of snapping holes on an inner surface, an annular flange on a top, a plurality of projecting members on an inner surface of the annular flange, and a projecting element on an outer surface of the annular groove of the lid so that a chip is configured to dispose on the bottom of the lid; and a circular member disposed in the bottom of the lid and including a plurality of projecting members configured to complementarily dispose in the snapping holes of the lid respectively, a recessed top for covering the chip, and an annular flange on a bottom;

a cylindrical locking device including two spaced ribs on a surface, an upwardly projecting tubular insertion member, the locking device having a plurality of projecting members on an inner surface, a plurality of projecting elements on the inner surface, an opening through a surface of the tubular insertion member, an outward extending rim on a top, an inward extending rim on the top, two opposite tabs on the outward extending rim, two spaced recesses on the inward extending rim with the ridges moveably disposed therein wherein the inward extending rim is configured to rotate on the recessed portion, a gap through the outward extending rim, the inward extending rim, and the surface wherein size of the gap is flexibly decreased when the tubular insertion member is assembled, wherein the ratchet seat is in the housing and the ratchet seat and the tubular insertion member are assembled, wherein the tubular insertion member is configured to move upward or downward in the ratchet seat, and wherein the downward extending peg catches the outward extending rim so that the ratchet seat is prevented from being disengaged from the tubular insertion member;

an arcuate plate including an opening through a surface, a plurality of holes through the surface, and an arcuate flange on a bottom wherein the arcuate plate is inserted through the bottom of the locking device into the tubular insertion member to dispose between the ridges wherein the holes of the arcuate plate are blocked by the tubular insertion member, and wherein the arcuate flange of the arcuate plate urges against the bottom of the locking device;

an annular cover including an annular trough on a top with the flange of the arcuate plate received therein, an annular flange in a central portion of the annular trough of the cover, and an annular groove on a bottom wherein the cover is disposed at the bottom of the locking device, and wherein the projecting elements of the locking device urge against an outer surface of the cover, thereby assembling the container lid assembly; and a container including a plurality of protuberances on an outer surface of an upper portion, and an annular protrusion on an outer surface of a lower portion, the projecting members are fastened by the protrusion when the bottom of the locking device and the container are assembled, a top of the container is rotatably disposed in the annular groove;

wherein the space of the storing member is configured to store another kind of medicine and the lid is configured to pivot to close the space of the storing member by inserting the projecting element of the lid into the snapping hole of the annular flange, and the annular flange of the circular member urges against the storing member in an airtight manner;

wherein the container lid assembly is releasably secured to the container, the movable lid unit is locked by the locking device, the movable lid unit is capable of rotating but not capable of opening, and it is impossible of taking capsules out of the container; and wherein for taking out the capsules in the container, a rotation of the movable lid unit aligns the ribs of the housing with the ribs of the locking device respectively, the ridges of the storing member are inserted into the recesses of the locking device respectively, a pulling of the movable lid unit until being stopped aligns the opening of the storing member with the inward extending rim of the locking device, and the downward extending peg of the ratchet seat catches the outward extending rim of the locking device so that the ratchet seat is prevented from being disengaged from the tubular insertion member of the locking device, the holes of the arcuate plate are blocked by the tubular insertion member of the locking device in a closed state, the tab of the tubular insertion member is locked in the recess of the rotatable symbol ring for positioning the movable lid unit, a rotation of the ratchet seat until being stopped urges the peg of the ratchet seat against the tab of the locking device, the projection of the ratchet seat is on a top of the tab of the locking device to prevent the movable lid unit from moving downward, the opening of the tubular insertion member is aligned with the opening of the arcuate plate in an open state, the rotatable symbol ring is configured to rotate to show change of symbol, and the capsules in the container are configured to be taken out of the opening of the tubular insertion member.

* * * * *